US006379024B1

(12) United States Patent
Kogure et al.

(10) Patent No.: US 6,379,024 B1
(45) Date of Patent: Apr. 30, 2002

(54) DIELECTRIC BARRIER EXCIMER LAMP AND ULTRAVIOLET LIGHT BEAM IRRADIATING APPARATUS WITH THE LAMP

(75) Inventors: Yasuo Kogure; Norio Kobayashi; Katsumi Hiratsuka; Satoru Amano, all of Tokyo (JP)

(73) Assignee: Hoya-Schott Corporation, Tokyo (JP)

( * ) Notice: Subject to any disclaimer, the term of this patent is extended or adjusted under 35 U.S.C. 154(b) by 0 days.

(21) Appl. No.: 09/718,404

(22) Filed: Nov. 24, 2000

(30) Foreign Application Priority Data

Nov. 29, 1999 (JP) ..... 11-338817
Nov. 29, 1999 (JP) ..... 11-338818

(51) Int. Cl.[7] ..... H01J 11/00

(52) U.S. Cl. ..... 362/263; 313/113; 313/607; 313/234

(58) Field of Search ..... 362/263, 264, 362/265; 313/634, 607, 234, 113, 17, 18, 24, 31, 22, 26, 36

(56) References Cited

U.S. PATENT DOCUMENTS 3,337,762 A * 8/1967 Vincent ..... 313/113
5,510,158 A 4/1996 Hiramoto et al.
5,581,152 A * 12/1996 Matsuno et al. ..... 313/113
5,757,132 A * 5/1998 Matsuno et al. ..... 313/234
5,763,999 A * 6/1998 Matsun et al. ..... 313/234

* cited by examiner

*Primary Examiner*—Sandra O'Shea
*Assistant Examiner*—Hargobind S. Sawhney
(74) *Attorney, Agent, or Firm*—Nixon & Vanderhye

(57) ABSTRACT

Disclosed is a dielectric barrier excimer lamp which is easy to handle, less expensive and improved in ultraviolet light beam irradiation efficiency to electric power and ultraviolet light beam irradiation efficiency to a work.

The dielectric barrier excimer lamp comprises a dual tube having an inner tube, an outer tube and a discharge gas sealed in a space between the inner and outer tubes, a case for housing said dual tube, a light-transmitting outer electrode including a network-shaped region disposed on an external-surface side of said outer tube and an inner electrode disposed on an inner-surface side of said inner tube, or comprises a dual tube in which the above discharge gas is sealed, a network-shaped first electrode disposed on the outer circumferential surface of said outer tube, a second electrode disposed in the inner circumferential surface of said inner tube, and a first tube for internally housing said dual tube together with said electrodes inside thereof, an inert gas being introducible into a space between said first tube and said outer tube, wherein a voltage is applied between the electrodes to radiate an ultraviolet light beam.

28 Claims, 12 Drawing Sheets

DIELECTRIC BARRIER EXCIMER LAMP AND ULTRAVIOLET LIGHT BEAM IRRADIATING APPARATUS WITH THE LAMP

Technical Background

1. Field of the Invention

The present invention relates to a dielectric barrier excimer lamp and an ultraviolet light beam irradiating apparatus to which the dielectric barrier excimer lamp is applied. More specifically, the present invention relates to a dielectric barrier excimer lamp for cleaning or modifying the surface of a semiconductor wafer or a glass substrate by means of joint activities of ultraviolet light beam and ozone, and an ultraviolet light beam irradiating apparatus having the dielectric barrier excimer lamp.

2. Related Art Statement

In recent years, studies are being widely made with regard to a method for cleaning or modifying a work such as a metal, a semiconductor substance or a glass by means of the joint activities of ultraviolet light beam and ozone. The above method is generally known as a UV ozone method. The UV ozone method has advantages that an organic contaminant adhering to a work surface can be removed, and that an oxide film can be formed on the surface, without damaging the work.

In the UV ozone method, air containing oxygen or oxygen gas is irradiated with 185 nm light that is a vacuum ultraviolet light beam radiated from a low-pressure mercury lamp, whereby ozone is generated. Active oxygen species that is a decomposed gas from ozone is generated from the ozone and brought into contact with a work surface. In cleaning the work by the UV ozone method, an organic contaminant adhering to the work surface is oxidized upon contact with the active oxygen species and converted to low-molecular oxides such as carbon dioxide and water, whereby it is removed from the surface. In this manner, the work surface can be finely dry-cleaned.

A low-pressure mercury lamp has greatly contributed to wide use of the above UV ozone cleaning due to its characteristic emitted light beam, and in recent years, a dielectric barrier excimer lamp has come to be known as a light source capable of providing more efficient cleaning and is replacing the conventional low-pressure mercury lamp as a light source for the UV ozone cleaning. The dielectric barrier excimer lamp has advantages that it overcomes the problems of heat radiation to a substrate, lighting performance, etc., which have been defects of the low-pressure mercury lamp, further that it has an emitted light beam having a shorter wavelength so that it is excellent in breaking an organic compound and that it can more efficiently generate active oxygen.

FIG. 13 shows one constitution of a conventional dielectric barrier excimer lamp unit. As shown in FIG. 13, a lamp unit 40 has an excimer lamp 42 inside a metal container 41. The excimer lamp 42 has an inner cylindrical tube 42*a* and an outer cylindrical tube 42*b* both made of quartz glass and has a discharge gas 43 such as xenon gas charged in a space between these tubes. And, a high voltage is applied between electrodes 42*c* and 42*d* provided inside and outside the tubes (the electrode on the outside thereof has the form of a network) from an alternate current power source (not shown), whereby the excimer lamp 42 radiates ultraviolet light. That is, upon application of the high voltage, the quartz glass that is a dielectric material generates a microdischarge due to dielectric barrier discharge (silent discharge), to excite and combine the discharge gas 43 charged inside with the energy of the microdischarge, and the gas molecules in an excited state radiate light beam having a wavelength characteristic of the gas in the process of the gas molecules restoring their ground state.

The metal container 41 of the lamp unit 40 has a light window 44 made of a synthetic quartz glass, and an ultraviolet light beam radiated from the excimer lamp 42 is transmitted through it and a work is irradiated therewith. In the metal container 41, an inert gas such as nitrogen gas is constantly flowed at a rate of several liters per minute, so that the attenuation of the ultraviolet light beam from the excimer lamp 42 controlled to make it as small as possible. Further, the metal container 41 internally has a reflection plate 45 (or the inner wall surface of the metal container is mirror-processed), whereby an ultraviolet light beam radiated upward and sideward from the excimer lamp 42 is reflected thereon and led toward the light window 44. The ultraviolet light beam which comes out of the container through the light window 44 generates ozone and active oxygen species due to its photochemical reaction in an oxygen-containing atmosphere where a work is placed, to bring them into contact with the surface of the work, and further, the work is irradiated directly with this vacuum ultraviolet light beam, so that the cleaning and modification of the work is attained by co-working of these.

However, the above conventional dielectric barrier excimer lamp unit has the following problems.

(1) Ultraviolet light beam radiated upward and sideward from excimer lamp 42 is reflected on the reflection plate 45 and lead toward the light window 44. However, the reaching efficiency thereof is very low, and most of the above ultraviolet light beam radiated upward comes to nothing. The radiation efficiency of ultraviolet light beam based on power inputted to the excimer lamp 42 is very poor.

(2) The synthetic quartz used as a material for the above light window 44 is expensive and increases the cost of the unit. Particularly in a unit in which a plurality of the excimer lamps 42 are provided in the metal container 41 for broadening the irradiation region of the ultraviolet light beam, the light window 44 has a large area, which causes a serious cost problem.

(3) The above light window 44 made of the synthetic quartz causes so-called solarization which is a phenomenon that a color center is generated with slight impurities such as iron and manganese due to irradiation with ultraviolet light beam and blackening takes place. The transmitted-light quantity is attenuated due to the solarization, and as a result, the cleaning effect decreases.

(4) The inert gas such as nitrogen that is flowed into the metal container 41 is effective for decreasing absorption of ultraviolet light beam in the container. On the other hand, it requires an additional cost, and handling thereof requires labors in view of environmental protection.

(5) The outer electrode 42*d* is exposed on the outer circumference of the excimer lamp 42, so that it is required to take care when the excimer lamp 42 is attached inside the metal container 41. For this reason, the position of the excimer lamp 42 relative to the container is liable to vary when the excimer lamp 42 is attached, and the variability may influence the irradiation performance of the unit.

(6) The above metal container 41 has a relatively large space around the excimer lamp 42 for disposing the above reflection plate and attaching the excimer lamp 42. It is therefore required to constantly flow the inert gas necessary for filling the space with it at a rate of approximately several liters per minute, so that the consumption thereof comes to be very large.

(7) For improving the efficiency of cleaning or modifying the work with ultraviolet light beam, preferably, the distance between the surface of the excimer lamp 42 and the work is shortened so as to make it as small as possible, and the ultraviolet light beam is increased in radiation light quantity. In the conventional lamp unit, however, it is difficult to shorten the above distance due to its structure in which the excimer lamp is housed in the metal container.

SUMMARY OF THE INVENTION

Under the circumstances, it is a first object of the present invention to provide a dielectric barrier excimer lamp which can be improved in ultraviolet light beam radiation efficiency relative to power inputted to the excimer lamp and ultraviolet light beam irradiation efficiency to a work, which is easy to handle and less expensive and which attains the performance of a low running cost.

It is a second object of the present invention to provide an ultraviolet light beam irradiating apparatus with a dielectric barrier excimer lamp having the above excellent characteristics.

For achieving the above objects, the present inventors have made diligent studies and have found that the above objects can be achieved by a specifically structured dielectric barrier excimer lamp having at least a dielectric dual tube made of an inner tube, a light-transmitting outer tube and a discharge gas sealed in a space between these tubes and a pair of electrodes. The present invention has been accordingly completed on the basis of the above finding.

That is, the first object of the present invention can be achieved by (1) a dielectric barrier excimer lamp comprising a dielectric dual tube having an inner tube, a light-transmitting outer tube and a discharge gas sealed in a space between the inner and outer tubes, a case for housing said dual tube, the case being opened at least on one side of said dual tube in radius direction of said dual tube, an outer electrode which is fixed in an opened region of said case and includes a network-shaped region disposed close to the external-surface side of said outer tube on one side of said dual tube, and an inner electrode disposed on an inner-surface side of said inner tube which inner-surface side corresponds at least to the region of the surface of said outer tube which surface is the surface close to which said outer electrode is disposed, wherein a voltage is applied between said outer electrode and said inner electrode to radiate ultraviolet light beam through said network-shaped outer electrode (to be referred to as "the dielectric barrier excimer lamp I" of the present invention), and (2) a dielectric barrier exciner lamp comprising a dielectric dual tube having an inner tube, a light-transmitting outer tube and a discharge gas sealed in a space between the inner and outer tubes, a network-shaped first electrode disposed close to the outer circumferential surface of said outer tube, a second electrode disposed close to the inner circumferential surface of said inner tube, and a light-transmitting dielectric first tube for internally housing said dual tube together with said first and second electrodes, an inert gas being introducible into a first space between said first tube and said outer tube, wherein a voltage is applied between said first and second electrodes to radiate ultraviolet light beam (to be referred to as "the dielectric barrier excimer lamp II" of the present invention).

Further, the second object of the present invention can be achieved by an ultraviolet light beam irradiating apparatus with the above dielectric barrier excimer lamp I or II.

Figure 1:
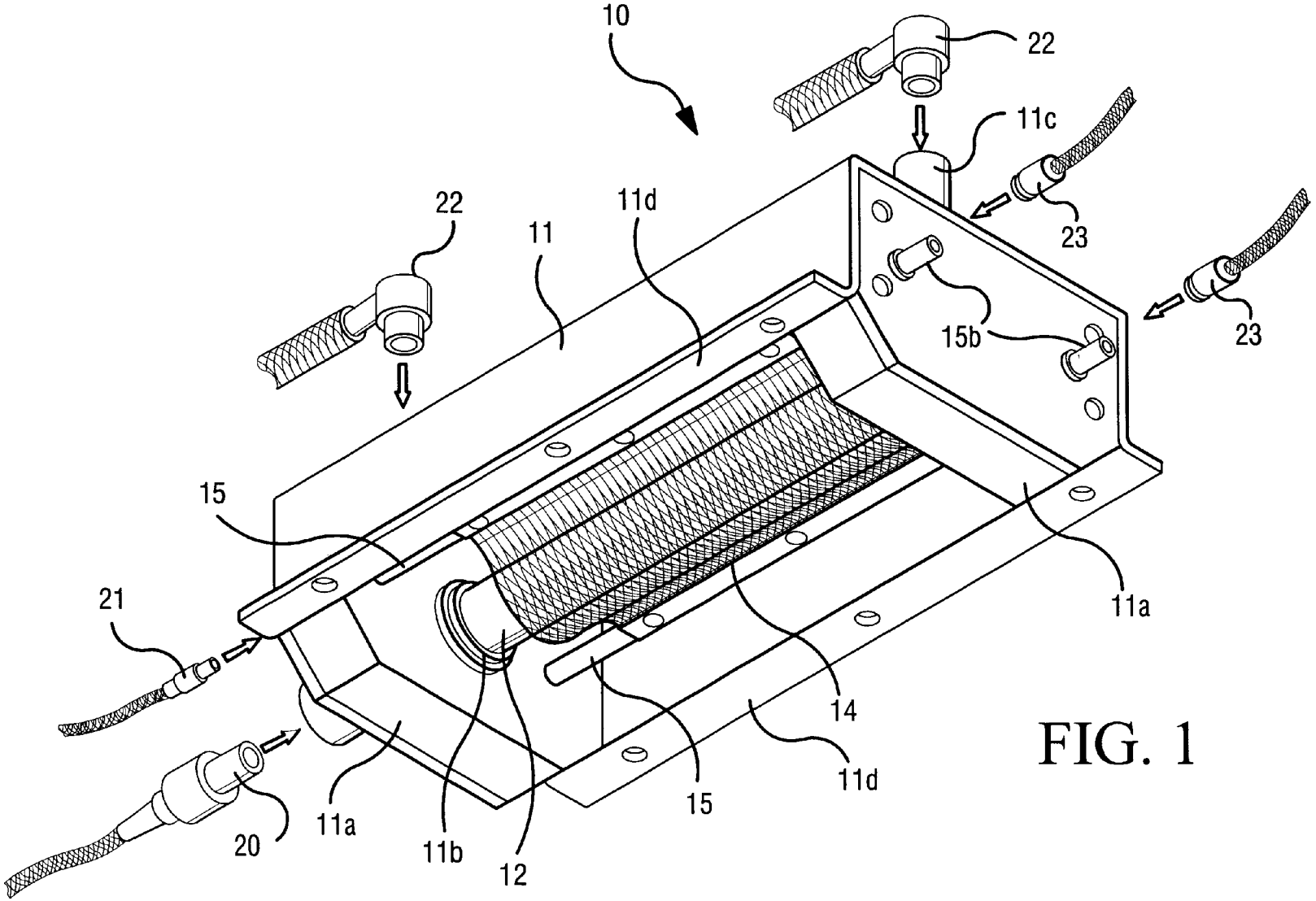
FIG. 1 is a perspective view of an appearance of one example of the dielectric barrier excimer lamp of the present invention.

In the drawings, reference numeral 10 indicates the dielectric barrier excimer lamp of the present invention, 11 indicates a case, 12 indicates a dual cylindrical tube, 12*a* indicates an outer tube, 12*b* indicates an inner tube, 13 indicates an inner electrode, 14 indicates an outer electrode, 15 indicates a gas flow tube, 16 indicates xenon gas, 22 indicates a cooling water tube, 23 indicates a gas tube, 40 indicates a conventional dielectric barrier excimer lamp unit, 50 indicates an ultraviolet light beam irradiating apparatus , 60 indicates the dielectric barrier excimer lamp of the present invention, 61 indicates a glass tube, 62 indicates an outer electrode, 63 indicates a dual tube, 63*a* indicates an outer tube, 63*b* indicates an inner tube, 64 indicates an inner electrode, 65 indicates a gas tube, 74 indicates a reflection plate, 82 and 83 indicate cooling water tubes, 87 and 88 indicate gas tubes, 90 indicates an ultraviolet light beam irradiating apparatus , G indicates xenon gas, and W indicates a work.

PREFERRED EMBODIMENTS OF THE INVENTION

The dielectric barrier excimer lamp of the present invention includes two embodiments, and the dielectric barrier excimer lamp I will be explained first.

The dielectric barrier excimer lamp I has a dual tube made of a dielectric material, preferably, a quartz glass, the dual tube having an inner tube, a light-transmitting outer tube and an excimer gas, preferably a discharge gas such as xenon gas, sealed in a space between the inner and outer tubes, a case for housing the above dual tube, the case being opened at least on one side in radius direction of said dual tube, an outer electrode which is fixed in an opened region of the above case and includes a network-shaped region disposed close to an external-surface side of the above outer tube in one side of the above dual tube, and an inner electrode disposed on an internal-surface side of the above inner tube which internal-surface side corresponds at least to the region of the surface of the above outer tube which surface is the surface close to which the above outer electrode is disposed, and the dielectric barrier exciner lamp (I) is constituted to radiate ultraviolet light beam through the above network-shaped outer electrode upon application of a voltage between the above outer electrode and the above inner electrode.

In the above embodiment, the above dual tube is a cylindrical tube.

Preferably, the network-shaped region of the above outer electrode is in contact with an external surface of the above outer tube, and more preferably, the contact angle of the above outer electrode to the above outer tube in the circumferential direction of the above dual tube is 180° or less.

Further, preferably, the above outer electrode is fixed to the above case such that the network-shaped region is pressed to the external surface of the above outer tube.

In this case, the above outer electrode has a fixing portion to the above case on each side of the above dual tube in the axial direction of the above dual tube, and the above outer electrode can be fixed to the above case via said fixing portions.

Further, preferably, the above case is made of a metal, and the above outer electrode is fixed to the case through an insulating member.

Further, there may be employed a constitution in which the above inner electrode extends in the direction of the circumference of the above inner tube and extends along half of said circumference.

Further, the present invention may have a constitution further including an inert gas ejecting means which is disposed along the axial direction of the above dual tube and which is for ejecting an inert gas toward an irradiation region of ultraviolet light beam radiated through the above outer electrode.

Preferably, the above inert gas ejecting means is disposed on each side of the above dual tube along the axial direction of the above dual tube.

Further, preferably, the above inert gas ejecting means is fixed to the above case so as to be present inside from the above outer electrode, and an inert gas is ejected toward the above irradiation region of ultraviolet light beam through the above outer electrode.

Figure 2:
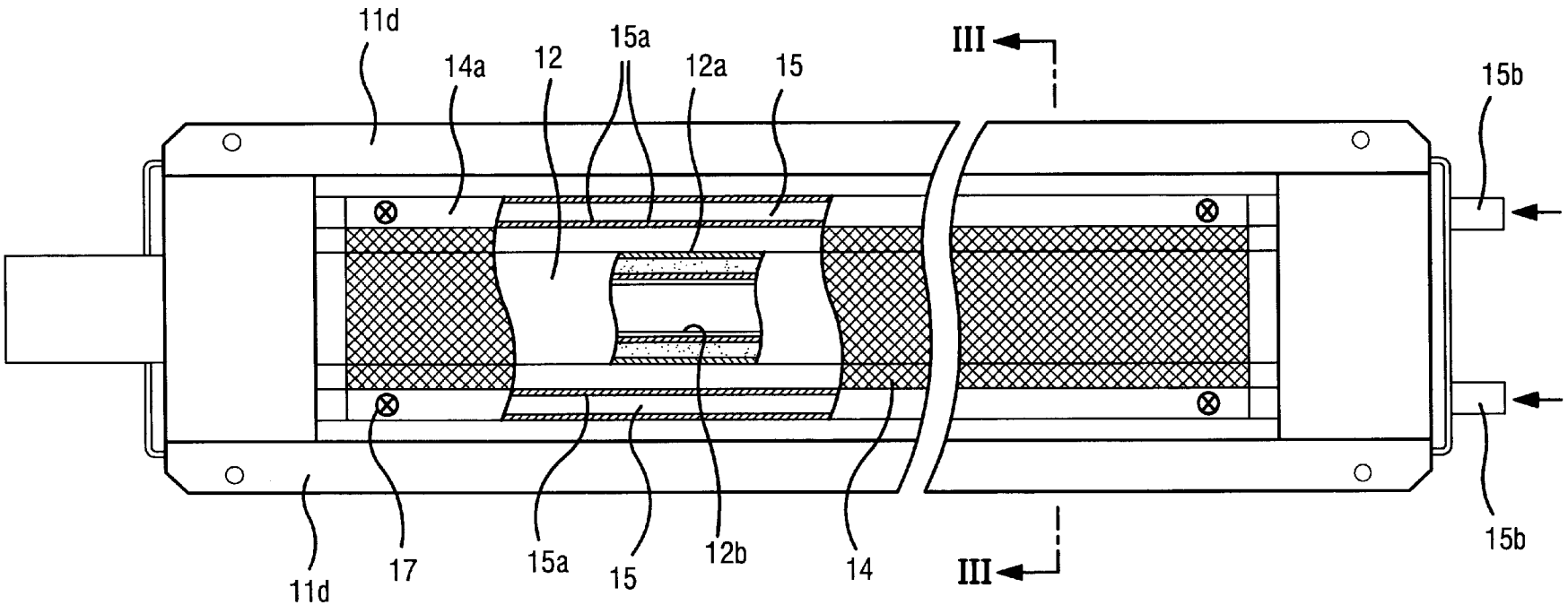
FIG. 2 is a bottom view of the dielectric barrier excimer lamp shown in FIG. 1.

FIG. 1 shows a perspective view of appearance of one Example of the dielectric barrier excimer lamp I of the present invention, and FIG. 2 shows a bottom view thereof. The outline of the constitution of the dielectric barrier exciner lamp I of this Example will be explained with reference to these drawings hereinafter.

In FIG. 1, the dielectric barrier excimer lamp I 10 basically has a dual cylindrical tube 12 as an excimer light source, which cylindrical tube 12 is supported in a case 11 made of a metal, preferably, stainless steel. The case 11 has its lower side opened so that a work can be irradiated with an ultraviolet light beam from the dual cylindrical tube 12, and each of ends thereof has a support block ll*a* for supporting the dual cylindrical tube 12. In each support block 11*a*, a circular hole 11*b* having dimensions fit to outer dimensions of the dual cylindrical tube 12 is made, and ends of the dual cylindrical tube 12 are fitted into them through an insulating resin member such as Teflon. One end of the dual cylindrical tube 12 is placed through one support block 11*a* so that an HV connector 20 from a power source unit can be connected thereto. A high voltage from the power source unit (not shown) is provided to an inner electrode 13 (see FIG. 3) disposed inside the dual cylindrical tube 12 through the HV connector 20.

The case 11 has inlets 11*c* and 11*c* for fitting cooling water tubes 22 near its two upper ends. The inlets 11*c* and 11*c* communicate with an inner tube of the dual cylindrical tube 12 inside the support blocks 11*a* and 11*a*. Cooling water supplied through one of the above cooling water tubes 22 passes through the inside of the above inner tube to cool it and discharged into the other cooling water tube 22. The discharged cooling water is again circularly supplied into the dual cylindrical tube 12 through a condenser and an impurity-removing filter that are not shown. In a preferred example, the cooling water is pure water having a specific resistivity of 0.5 MΩ·cm or higher or such pure water containing ethylene glycol.

The dielectric barrier excimer lamp I 10 also has an outer electrode 14 having a network-shaped region and two gas flow tubes 15 and 15 made of a metal. The outer electrode 14 is disposed below the dual cylindrical tube 12, i.e., on the opening side of the case 11, as is shown in the drawing. The outer electrode 14 is fixed to the case 11 (directly to the gas flow tubes 15) in each side and is in contact with the dual cylindrical tube 12 in a state where it is pressed thereto under a predetermined tension, as will be described later. A GND connector 21 is connected to one end of one gas flow tube 15 projected out of the case, and the outer electrode 14 is grounded through the above gas flow tube 15 made of a metal. In this manner, a high voltage (e.g., 7 to 10 kV, 100 to 500 kHz) is applied between the inner electrode 13 and the outer electrode 14 from the above power source unit, to excite xenon or other discharge gas in the dual cylindrical tube 12 present between them. A setting embodiment of the outer electrode 14 will be explained in detail later.

The gas flow tubes 15 are cylindrical tubes which are for spraying an inert gas such as nitrogen gas, argon gas, or the like to the irradiation region of an ultraviolet light beam with the dual cylindrical tube 12 and have one open end each. Holes 15*a* are made in each gas flow tube 15 at regular intervals along their longitudinal direction, and the inert gas is sprayed through them. Like the dual cylindrical tube 12, ends of each gas flow tube 15 are inserted into the support blocks 11*a* and 11*a* and supported with them. Preferably, each gas flow tube 15 is supported through an insulating resin member such as Teflon, so that the gas flow tubes 15 are electrically isolated from the case 11, whereby an electric shock is prevented even when the case is erroneously touched during the application of a high voltage. One open end 15*b* of each gas flow tube 15 is projected out of the case 11, so that the inert gas can be introduced through them. That is, gas tubes 23 connected to an inert gas supply source (not shown) are connected to the "one" ends 15*b* of the gas flow tubes 15, whereby the inert gas is introduced into the gas flow tubes 15 and ejected through each hole 15*a*. The case 11 has a fixing flange lid on each side and can be fixed to a box of the ultraviolet light beam irradiating apparatus through the fixing flanges 11*d*.

Figure 3:
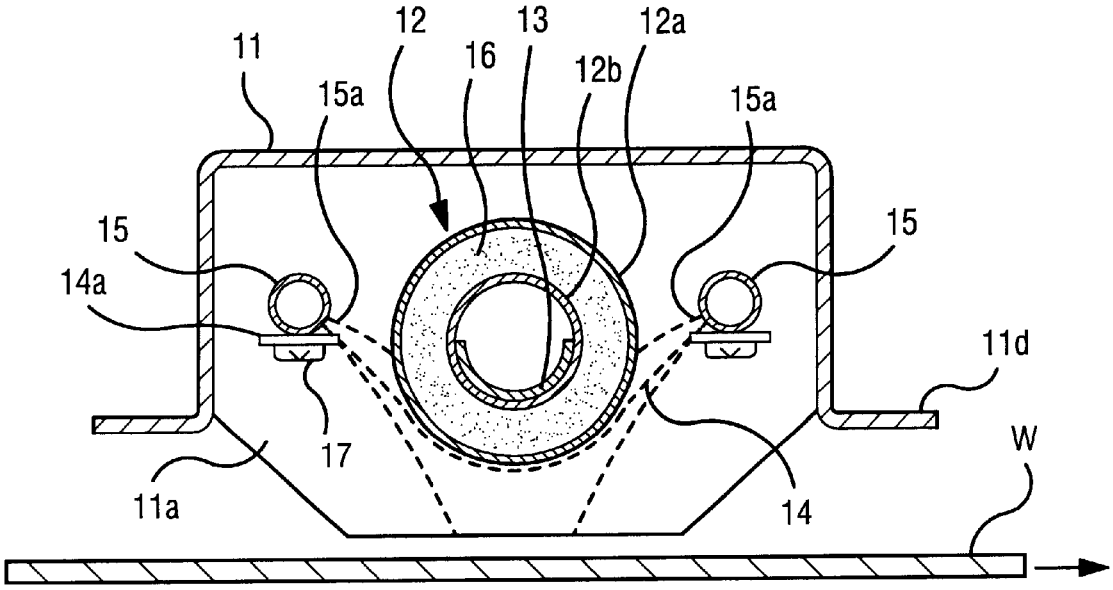
FIG. 3 is a cross-sectional view taken along a line A—A in FIG. 2.
Figure 4:
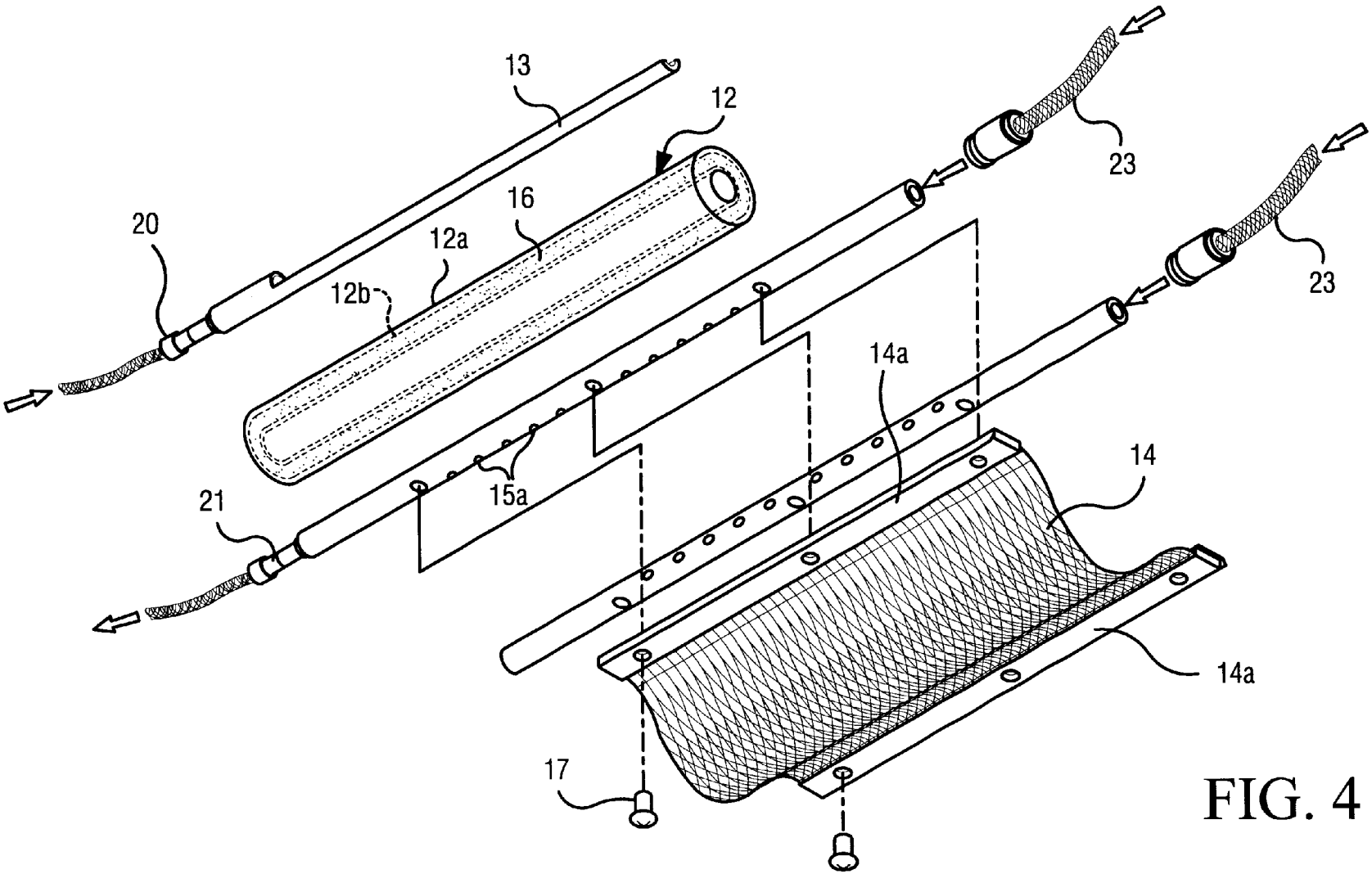
FIG. 4 is an exploded perspective view of the dielectric barrier excimer lamp shown in FIG. 1.

FIG. 3 shows a cross-sectional view taken along a line A—A in FIG. 2. This FIG. 3 clearly shows the structure of the dual cylindrical tube 12 and the layout of the inner electrode 13, the outer electrode 14 and the gas flow tubes 15. Further, FIG. 4 shows an exploded perspective view of constitution of the dielectric barrier excimer lamp I 10 excluding the case 11. This FIG. 4 clearly shows the form of each of the dual cylindrical tube 12, the inner electrode 13, the outer electrode 14 and the gas flow tubes 15. Each of the above elements will be explained in detail mainly with reference to these drawings hereinafter.

In these drawings, the dual cylindrical tube 12 is constituted by coaxially arranging an outer tube 12*a* and an inner tube 12*b* made of synthetic quartz glass as a dielectric material, and xenon gas 16 as a discharge gas is sealed in a space between these two tubes 12*a* and 12*b*. That is, the outer tube 12*a* and the inner tube 12*b* are integrated in each end, whereby the xenon gas is sealed in a closed space formed in their gap. A high voltage is applied between the above inner electrode 13 and the above outer electrode 14, whereby xenon atoms in the dual cylindrical tube 12 are excited into an excimer state, and an ultraviolet light beam having a wavelength of approximately 172 nm is emitted when xenon atoms are restored from the above excimer state. In the present invention, as a discharge gas to be sealed in, the above xenon gas may be replaced with neon fluoride gas (wavelength 108 nm), argon gas (126 nm), krypton gas (146 nm), fluorine gas (157 nm), argon chloride gas (175 nm) or argon fluoride gas (193 nm). Further, for a light emission region of an ultraviolet light beam, the discharge gas can be selected from krypton chloride gas (222 nm), krypton fluoride gas (248 nm), xenon chloride gas (308 nm) or xenon fluoride gas (351 nm). In on example, the dual cylindrical tube 12 has a total length of 460 mm, an outer diameter of approximately 30 mm, an inner diameter of approximately 17 mm, a tube thickness of approximately 1 mm and a discharge gap of approximately 5 mm.

The inner electrode 13 is a metal plate having a semicircular cross section and is disposed along the lower half of inner surface of the inner tube 12*b* of the above dual cylindrical tube 12. The inner electrode 13 is formed such that its curvature in its cross-sectional direction is nearly in agreement with the curvature of the inside of the above inner tube 12*b*, whereby the outer surface of the inner electrode 13 is in surface contact with the inner surface of the inner tube 12*b*. It is sufficient that the inner electrode 13 should be disposed in the region which corresponds to the region where the above outer electrode 14 is in contact with the outer tube 12*a* of the dual cylindrical tube 12, so that the inner electrode 13 can be formed so as to have a thinner than that in Example. As described above, the HV connector 20 is fitted to one end of the inner electrode 13, so that electric power can be supplied from a power source unit. The material for the inner electrode 13 is preferably a copper alloy or a stainless steel alloy.

The outer electrode 14 is a metal electrode having sides forming a fixing portion 14*a* each to the case 11 and having a region made of a flexible network-shaped metal wire between the fixing portions 14*a*. The outer electrode 14 is fixed to the case 11 by screwing the fixing portions 14*a* on the gas flow tubes 15 fixed to the case 11 with screws 17. In this case, as is clearly shown in FIG. 3, the outer electrode 14 is fixed under a constant tension such that the network-shaped region is wrapped around the lower surface side of the dual cylindrical tube 12 at a predetermined angle (to be referred to as "contact angle θ" hereinafter). When a high voltage is applied between the above inner electrode 13 and the above outer electrode 14, discharge is cause to take place in a space between above electrodes, that is, between the outer tube 12*a* and the inner tube 12*b*, and excimer gas in an internal region corresponding thereto is excited. In this Example, the outer electrode 14 (and the inner electrode 13) is (are) disposed only in a partial region (range in which the contact angle is θ) in the circumferential direction of the dual cylindrical tube 12. Therefore, excimer discharge takes place in such a region alone, and an ultraviolet light beam is radiated from such this region alone. The ultraviolet light beam emitted in the lower portion of the above dual cylindrical tube 12 is radiated to the surface of a work W through the network of the outer electrode 14.

In this Example, the above contact angle θ is determined depending upon relative attaching positions of the dual cylindrical tube 12 and the outer electrode 14. The above contact angle θ can be adjusted to a desired angle by changing the attaching position of the outer electrode 14 relative to the attaching position of the dual cylindrical tube 12. When the above contact angle θ is adjusted to a small angle, the electric power required to be applied between the electrodes can be decreased on one hand, and the irradiation range of ultraviolet light beam is narrowed on the other hand. When the above contact angle θ is adjusted to a large angle, the irradiation range of the ultraviolet light beam is broadened on one hand, and a larger electric power to be applied between the electrodes is required. The above contact angle θ is determined by taking account of a balance between these contradicting demands. In this Example, the contact angle θ is preferably in the range of from 30 to 180°. The material for the outer electrode 14 is preferably Monel Metal, a copper alloy or a stainless steel alloy.

As is clearly shown in FIG. 3, the gas flow tubes 15 are on both sides of the dual cylindrical tube 12 in the case 11. The gas flow tubes 15 have the gas-ejecting holes 15*a* formed along their longitudinal direction, and in the above state, the holes 15a are directed obliquely downward. The inert gas, such as nitrogen gas or argon gas, introduced into the gas flow tubes 15 from the gas tubes 23 are ejected through the holes 15*a* during the irradiation of the work W with the ultraviolet light beam, passes through the network of the above outer electrode 14 and sprayed to the irradiation region of the ultraviolet light beam, i.e., a region between the dual cylindrical tube 12 and the work W.

In the cleaning-modification of a work with the dielectric excimer light source, preferably, the distance between the dual cylindrical tube 12 and the work W is maintained such that the distance is as small as possible. That is because the influence of absorption of the ultraviolet light beam by oxygen present between them is decreased. On the other hand, minimizing the above distance has a limit due to the structural problem of a apparatus. In an ultraviolet light beam irradiating apparatus having a constitution in which the work W is moved relatively to the light source with a movable table, it is required to minimize the above distance while avoiding a contact risk. The introduction of the inert gas through the gas flow tubes 15 in this Example decreases the oxygen concentration in the above ultraviolet light beam irradiation region, whereby the absorption of the ultraviolet light beam is decreased. The diameter of the above gas flow tubes 15 and the number, the layout and the form of the holes 15*a* are properly determined depending upon a necessary supply amount and a spray region of the inert gas. In the present invention, the diameters and the forms of the holes may differ from one place to another, or the holes may be replaced with slits as outlets for ejecting the inert gas. In a preferred embodiment, each gas flow tube 15 has a diameter of 8 mm and a wall thickness of 1 mm.

Figure 5:
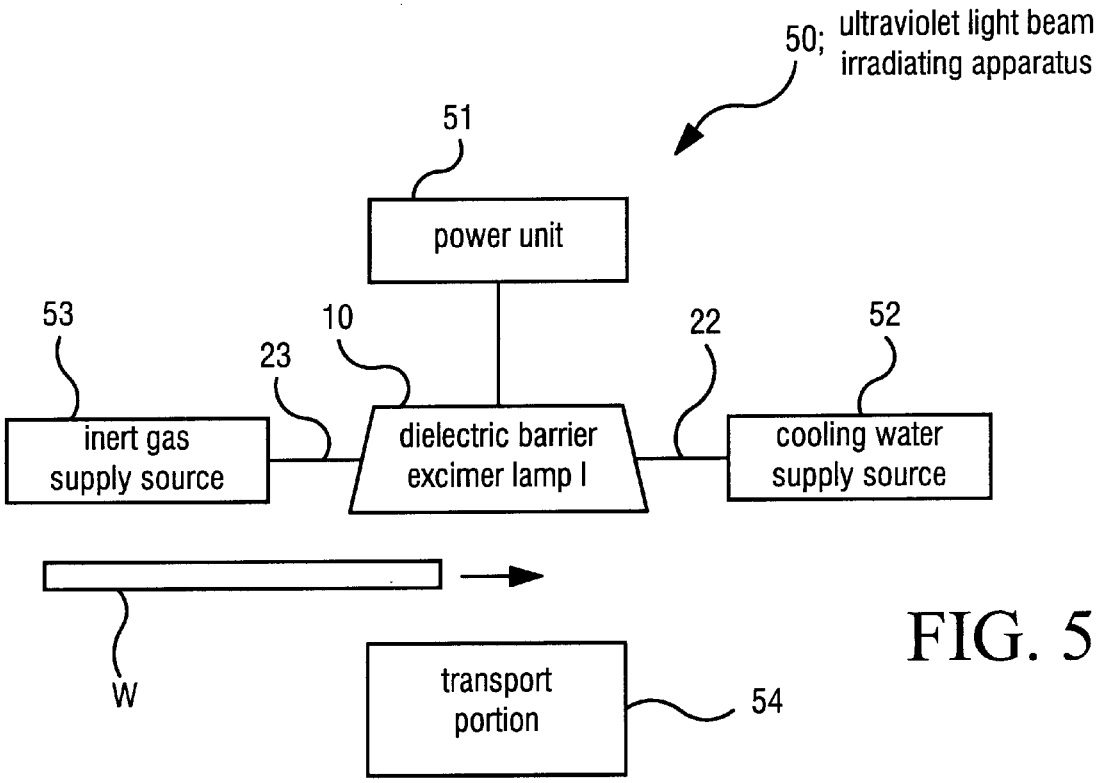
FIG. 5 is a block diagram of one example of the constitution of the ultraviolet light beam irradiating apparatus constituted by incorporating the dielectric barrier excimer lamp shown in FIG. 1.

FIG. 5 is a block diagram of constitution of one example of the ultraviolet light beam irradiating apparatus 50 of the present invention constituted by incorporating the above dielectric barrier excimer lamp I 10. The ultraviolet light beam irradiating apparatus 50 has the above-constituted dielectric barrier excimer lamp I 10, a power unit 51, a cooling water supply source 52, an inert gas supply source 53 and a transport portion 54.

The power unit 51 is for supplying a predetermined electric power to the electrodes (i.e., between the inner electrode 13 and the outer electrode 14) of the above dielectric barrier excimer lamp I 10 to emit the ultraviolet light beam. The supply of electric power from the power unit 51 is on-off controlled with a control portion disposed in the above power unit. The cooling water supply source 52 is for circularly supplying cooling water into the dual cylindrical tube 12 of the dielectric barrier excimer lamp I 10. The cooling water from the cooling water supply source 52 is supplied to the dual cylindrical tube 12 through a cooling water tube 22 and discharged from the dual cylindrical tube 12.

The inert gas supply source 53 is a means for supplying the inert gas to the above gas flow tubes 15, and the above inert gas is supplied through the above gas tubes 23. The gas supplied to the gas flow tubes 15 is sprayed to the ultraviolet light beam irradiation region as described above.

The transport portion 54 is a mechanism for transporting the rectangular work W such as a glass substrate in the horizontal direction to allow it to pass through the irradiation region of the ultraviolet light beam from the above dielectric barrier excimer lamp I 10. The transport portion 54 has a bed (not shown), which is for stably placing the work thereon and is moved together with the work. The height position of the bed is set such that the distance between the upper surface of the work to be placed thereon, i.e., a work surface, and the bottom portion of the dielectric barrier excimer lamp I 10 is 10 mm or less, preferably in the range of from 5 to 2 mm.

The ultraviolet light beam irradiating apparatus 50 having the above constitutions has a closed box (not shown) in which a stable atmosphere is maintained, and while the work W is transported inside the box, it is irradiated with the ultraviolet light beam from the above dielectric barrier excimer lamp I 10. The dielectric barrier excimer lamp I 10 can be attached to the upper portion of the above closed box through the fixing flanges 11*d* shown in FIG. 1. There may be employed a constitution in which a plurality of the above dielectric barrier excimer lamps 10 are provided in the above ultraviolet light beam irradiating apparatus for broadening the irradiation range of the ultraviolet light beam therefrom. In this case, there may be employed a constitution in which the work is supported in the box by fixing it therein without moving it.

The procedures of cleaning the work W with the above ultraviolet light beam irradiating apparatus 50 will be explained below. The work W is transported into the box of the ultraviolet light beam irradiating apparatus 50 with a robot hand (not shown) or the like to place it on the bed of the transport portion 54. The work W is fixed onto the bed with an arbitrary fixing means. Functions in the ultraviolet light beam irradiating apparatus 50 are initiated by pressing down a start control button or by an arbitrary control timing. That is, the supply of electric power from the power source unit 51, the supply of cooling water from the cooling water supply source 52, the supply of the inert gas from the inert gas supply source 53 and the transport of the work W with the transport portion 54 are initiated nearly simultaneously. The dielectric barrier excimer lamp I 10 radiates an ultraviolet light beam to the surface of the moving work W while the inert gas is sprayed, to carry out the cleaning thereof. During this procedure, the dielectric barrier excimer lamp I 10 is cooled with the above cooling water.

One Example of the dielectric barrier excimer lamp I of the present invention has been explained with reference to drawings hereinabove. However, the present invention shall not be limited to particulars disclosed in the above Example, and it is clear that the present invention is modifiable and improvable on the basis of descriptions of claims. In the above Example, the dual cylindrical tube 12 is supported in such a manner that two ends thereof are fit into the circular holes 11*b* of the support blocks 11*a*. However, the support structure shall not be limited thereto. For example, there may be employed a constitution in which the dual cylindrical tube 12 is arranged in such a manner that it is placed on the above outer electrode 14 fixed to the case 11 and the dual cylindrical tube 12 is pressed down on the outer electrode from above it.

In this Example, while the outer electrode 14 is fixed directly to the gas flow tubes 15, it may be fixed directly to the case 11. In this case, preferably, an insulating member is interposed between the case 11 and the outer electrode 14. Further, while this Example shows an embodiment in which the gas flow tubes 15 are disposed inside the outer electrode 14, there may be employed a constitution in which the gas flow tubes 15 are disposed outside the outer electrode, that is, in positions nearer to the work W. While the above Example shows a so-called water-cooled dielectric barrier excimer lamp in which cooling water is allowed to flow in the dual cylindrical tube 12, the present invention can be applied to an air-cooled dielectric barrier excimer lamp.

Since the dielectric barrier excimer lamp I of the present invention has the electrodes only on the work-setting side of the dual tube as described above, the radiation light quantity of the ultraviolet light beam to a work hardly decreases even if the power to the excimer lamp is decreased, so that the dielectric barrier excimer lamp I can be improved in irradiation efficiency.

Further, the dielectric barrier excimer lamp I of the present invention does not use any light window made of a synthetic quartz which involves problems on a cost and continuous light transmittance, and it is sufficient to use a small amount of the inert gas, so that it can be constituted with relatively low cost and that the running cost can be decreased.

The dielectric barrier excimer lamp II of the present invention will be explained hereinafter.

The dielectric barrier excimer lamp II has a dielectric dual tube having an inner tube, a light-transmitting outer tube and a discharge gas sealed in a space between the inner and outer tubes, a network-shaped first electrode disposed close to the outer circumferential surface of the above outer tube, a second electrode disposed close to the inner circumferential surface of the above inner tube, and a light-transmitting dielectric first tube for internally housing the dual tube together with the above first and second electrodes, an inert gas being introducible into a first space between said first tube and said outer tube, wherein a voltage is applied between the above first and second electrodes to radiate an ultraviolet light beam.

In a preferred embodiment of the present invention, the dielectric barrier excimer lamp II further has a gas inlet port which is connected to a supply source of the inert gas and is for introducing an inert gas into the above first space, and a gas outlet port for discharging the inert gas introduced into the above first space.

In the above case, preferably, the above first space and a second space inside the above inner tube are connected on a first end side of the above dielectric barrier excimer lamp such that gas can be allowed to flow through, the above gas inlet port and the above gas outlet port are disposed on a second end side of the above dielectric barrier excimer lamp, one of the above gas inlet port and the above gas outlet port is connected to the above first space on the second end side of the above dielectric barrier excimer lamp such that gas can be allowed to flow through, and the other thereof is connected to the above second space such that gas can be allowed to flow through.

Further, preferably, the dielectric barrier excimer lamp has a second tube for transporting the above inert gas into the above second space, one end of the above second tube is connected to one of the above gas inlet port and the above gas outlet port, and the other thereof is connected to the above first space.

Further, the present invention can have a constitution including a cooling water inlet port which is connected to a cooling water supply source and is for introducing cooling water into the second space inside the above inner tube and a cooling water outlet port for discharging the cooling water introduced into the above second space.

In this case, preferably, there is employed a constitution in which the above cooling water is introduced into a region outside the above second tube in the above second space.

Further, preferably, the above second electrode is tubular, the above tubular second electrode is spaced from the inner circumferential surface of the above inner tube so that the above second space is separated into a first region outside the above second electrode and a second region inside it, the above first region and the above second region are connected on the first end side of the above dielectric barrier excimer lamp such that a liquid can be allowed to flow through, the above cooling water inlet port and the above cooling water outlet port are disposed on the second end side of the above dielectric barrier excimer lamp, one of the above cooling water inlet port and the above cooling water outlet port is connected to the above first region on the second end side of the above dielectric barrier excimer lamp such that a liquid can be allowed to flow through, and the other thereof is connected to the above second region such that a liquid can be allowed to flow through.

Further, preferably, it is preferred to employ a constitution in which the above first and second electrodes are connected to a voltage source on the second end side of the above dielectric barrier excimer lamp.

In a preferred embodiment, the above dual tube, the above first tube, the above second tube and the above inner electrode are cylindrical tubes. Further, preferably, the above inner tube, the above outer tube and the above first tube are made of a quartz glass, and the discharge gas sealed in the above dual tube is xenon gas.

Further, the present invention can have a constitution including a reflection plate disposed so as to wrap the circumference of the above first tube and used for focusing an ultraviolet light beam radiated outside the above first tube to one side.

Figure 6:
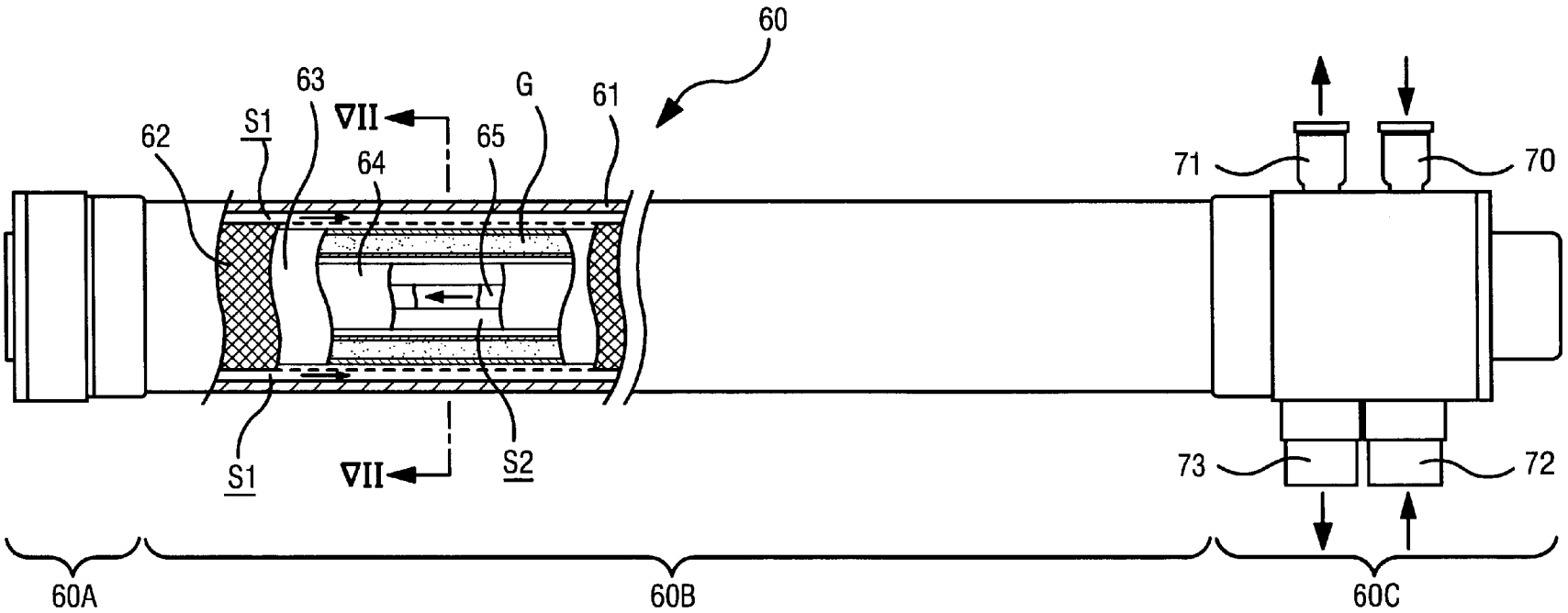
FIG. 6 is a partially exploded perspective view of another example of the dielectric barrier excimer lamp of the present invention different from that shown in FIG. 1.
Figure 7:
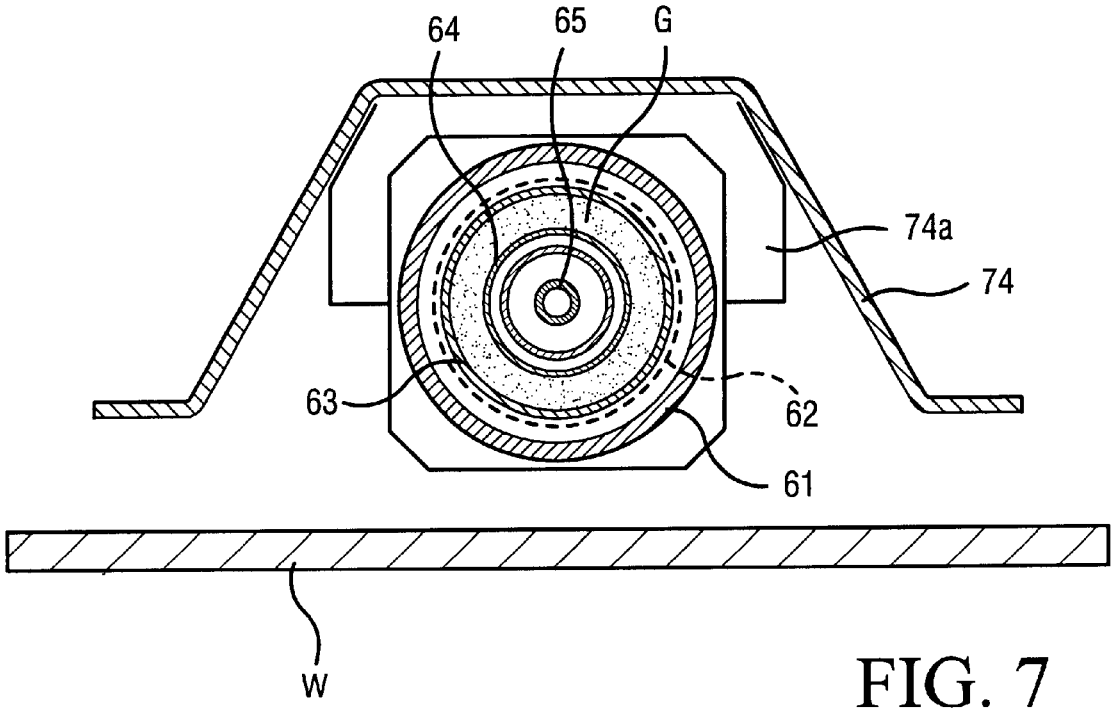
FIG. 7 is a cross-sectional view taken along a line A—A in FIG. 6.

FIG. 6 is a partial exploded appearance perspective view of the dielectric barrier excimer lamp II of one Example of the present invention. FIG. 7 is a cross-sectional view taken along a line A—A in FIG. 6. The outline of constitution of the dielectric barrier excimer lamp II of this Example will be explained with reference to these drawings.

The dielectric barrier excimer lamp II 60 has a columnar form as a whole and can emit an ultraviolet light beam from a region covered with a glass tube 61 to be described later. In FIG. 6, for an explanation purpose, an ultraviolet light beam irradiation region is named an irradiation portion 60B, a region on the forward end side is named a forward end portion 60A, and a region on the backward end side is named a base portion 60C. As shown in an exploded view in the drawing, inside the glass rube 61 in the irradiation portion 60B, a network-shaped outer electrode 62, a dual tube 63 having xenon gas G sealed therein as a discharge gas, an inner electrode 64 and a gas tube 65 are consecutively stacked toward an inside and disposed. The dielectric barrier excimer lamp II 60 is caused to emit an ultraviolet light beam, basically, by applying a high voltage between the above outer electrode 62 and the above inner electrode 64 to excite the xenon gas G sealed in the dual tube 63 between them.

The base portion 60C is provided with a terminal (not shown) for applying a voltage between the above outer electrode 62 and the above inner electrode 64, and a cable from the power source unit is connected thereto. Further, the base portion 60C has an inlet port ("gas inlet port 70" hereinafter) and an outlet port ("gas outlet port 71" hereinafter) for an inert gas such as nitrogen, argon or the like and further has an inlet port for introducing cooling water for cooling the lamp ("cooling water inlet port 72" hereinafter) and an outlet port for discharging the cooling water ("cooling water outlet port 73" hereinafter). A gas tube from a gas supply source (not shown) is connected to the above gas inlet port 70, and the inert gas is introduced into the dielectric barrier excimer lamp II 60 through it, circulated internally and discharged through the above gas outlet port 71 (to which a gas tube for discharge is connected). Further, a cooling water tube from a cooling water supply source (not shown) is connected to the above cooling water inlet port 72, and the cooling water is introduced into the dielectric barrier excimer lamp II 60, circulated internally and discharged through the above cooling water outlet port 73. The cooling water discharged through the cooling water outlet port 73 is recycled to the above cooling water supply source through a cooling water tube (not shown) connected thereto, and it is re-cooled and impurities are moved in the cooling water supply source. And, the cooling water is re-supplied circularly.

The inert gas introduced through the above gas inlet port 70 is finally introduced into a space S1 between the dual tube 63 and the glass tube 61 positioned outside it in the irradiation portion 60B. When the space S1 is filled with atmosphere, the ultraviolet light beam radiated from the dual tube 63 is absorbed into oxygen in the atmosphere, and the ultraviolet light beam to be irradiated from the glass tube 61 is greatly attenuated. In the present invention, the inert gas such as nitrogen or the like is allowed to flow into the above space S1 to replace the atmosphere in the above space with the inert gas, whereby the ultraviolet light beam from the dual tube 63 is radiated outside without being attenuated.

As will be described later, the above gas inlet port 70 is connected to one end of the above gas tube 65 in the base portion 60C. In the forward end portion 60A, further, the other end of the gas tube 65 is allowed to communicate with the above space S1 on the outside. In the base portion 60C, the above gas outlet port 71 is allowed to communicate with the above space S1. In this manner, the inert gas introduced through the gas inlet port 70 is introduced into the central gas tube 65 in the base portion 60C, reaches the forward end portion 60A through it and flows into the above space S1 therefrom. And, the inert gas that has flowed into the space S1 flows inside the irradiation portion 60B from the side of the above forward end 60A to the side of the base portion 60C and is discharged outside through the gas outlet port 71. Details of the above flow of the inert gas will be discussed later.

The cooling water introduced through the above cooling water inlet port 72 is introduced into a space S2 inside the dual tube 63 (and outside the above gas tube 65) in the irradiation portion 60B. While the above inner electrode 64 is disposed inside the dual tube 63, the inner electrode 64 comes to have a high temperature due to a high voltage applied for the irradiation with an ultraviolet light beam. The above cooling water introduced passes along the circumference of the above inner electrode 64 to cool it. Cooling the inner electrode 64 makes it possible to apply a higher voltage, so that the ultraviolet light beam irradiation quantity can be increased. In this Example, pure water having a specific resistivity of at least 0.5 MΩ·cm or higher, or such pure water containing ethylene glycol is suitably used as the above cooling water.

As will be described later, the inner electrode 64 is a cylindrical metal tube having an open end on each side, and disposed inside the above dual tube 63. The inner electrode 64 is formed so as to have an outer diameter that is smaller than the inner diameter of the dual tube 63 to some extent. When these two tubes are coaxially arranged, a space is formed between them. In other words, the inner electrode 64 separates the space S2 inside the dual tube 63 to a region S2*a* inside and a region S2*b* outside (see FIG. 8). In the base portion 60C, the above cooling water inlet port 72 is allowed to communicate with one side of the above region S2*a* inside. Further, the above region S2*a* inside and the above region S2*b* outside communicate with each other inside the forward end portion 60A (due to termination of end portion of the inner electrode 64). On the other hand, in the base portion 60C, the above cooling water outlet port 73 communicates with the above region S2*b* outside. In this manner, the cooling water introduced through the cooling water inlet port 72 is introduced into the region S2*a* inside the inner electrode 64 in the base portion 60C, reaches the forward end portion 60A through it and flows into the region S2*b* outside the inner electrode 64 therefrom. And, the cooling water passes through the region S2*b*, flows into the side of the base portion 60C and is discharged outside through the cooling water outlet port 73. Details of the above flow of the cooling water will be discussed later.

In the dielectric barrier excimer lamp II 60 in the above Example, the base portion 60C has the inert gas inlet port 70, the inert gas outlet port 71, the cooling water inlet port 72, the cooling water outlet port 73 and the connection terminal (not shown) to a cable from the power source unit as already described. Interfaces to external units and equipment are collected in one place as described above, whereby the installing freedom thereof is improved. That is, when the dielectric barrier excimer lamp II 60 is disposed in an ultraviolet light beam irradiating apparatus as will be described later, it is no longer necessary to provide the forward end portion 60A with a space for setting cables and tubes.

The dielectric barrier exciner lamp II 60 has a nearly trapezoid-shaped reflection plate 74 in its upper portion as shown in FIG. 7 (not shown in FIG. 6). The reflection plate 74 is fixed to the dielectric barrier excimer lamp II 60 through attaching members 74*a* (to be attached to the forward end portion 60A and the base portion 60C) to form coverings above the upper and side portions thereof. An ultraviolet light beams radiated upward and sideward from the dielectric barrier excimer lamp II 60 are reflected on the reflection plate 74 and directed toward the work W together with an ultraviolet light beam radiated downward therefrom.

Figure 8:
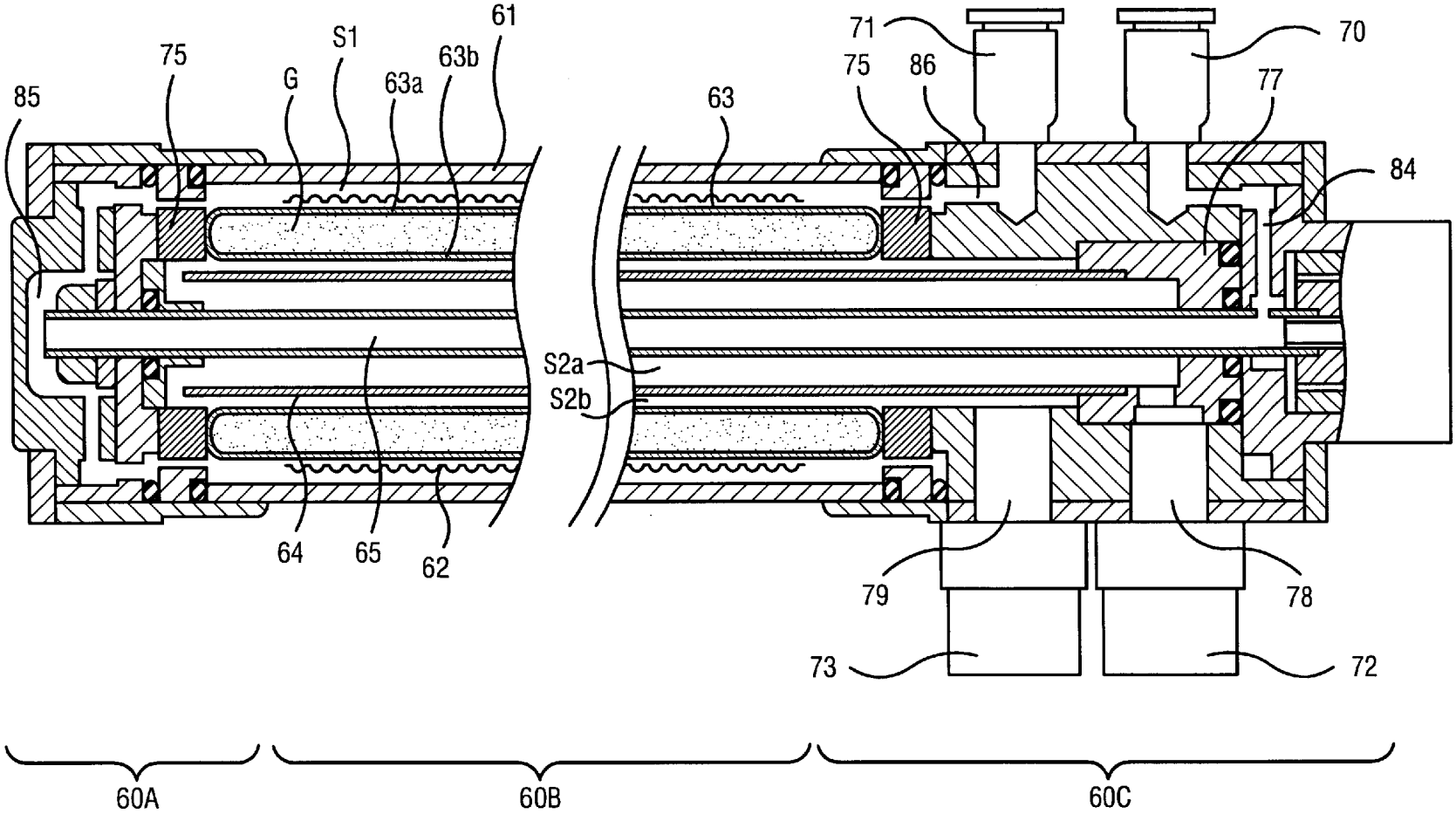
FIG. 8 is a longitudinally cut cross-sectional view of the dielectric barrier exciner lamp shown in FIG. 6.
Figure 9:
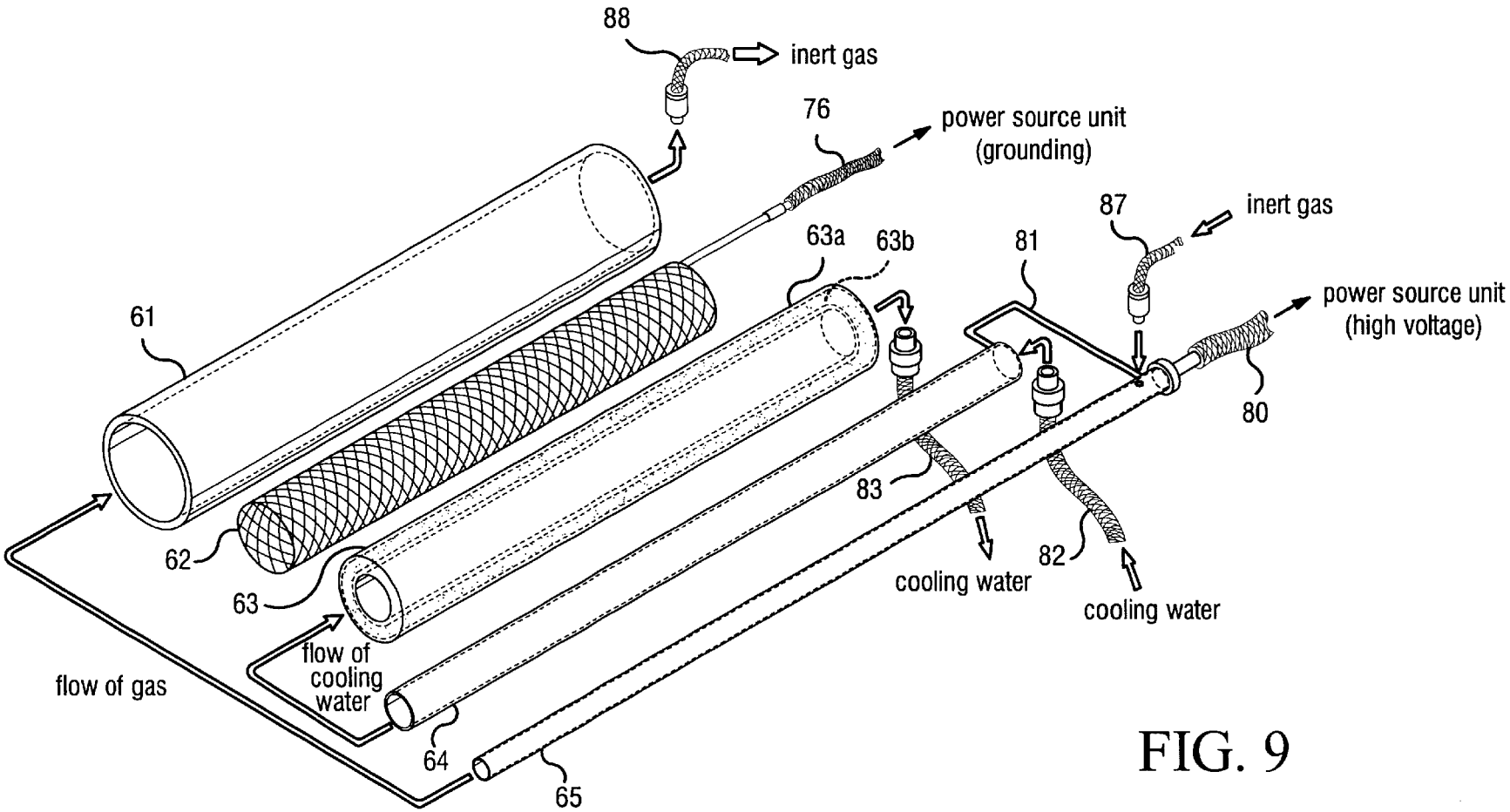
FIG. 9 is an exploded perspective view of the irradiation portion of the dielectric barrier excimer lamp shown in FIG. 6.

FIG. 8 is a longitudinally cut cross-sectional view of the dielectric barrier excimer lamp II 60, and it clearly shows what insides of the above forward end portion 60A, the irradiation portion 60B and the base portion 60 are like. Further, FIG. 9 is an exploded perspective view of constitution of the irradiation portion 60B of the dielectric barrier excimer lamp II 60, and it clearly shows the form of each of the glass tube 61, the outer electrode 62, the dual tube 63, the inner electrode 64 and the gas tube 65. Details of the above elements will be explained mainly with reference to these drawings.

In these drawings, the dual tube 63 is constituted by coaxially arranging an outer tube 63*a* and an inner tube 63*b* both made of a synthetic quartz glass as a dielectric material, and xenon gas G as a discharge gas is sealed between these two tubes 63*a* and 63*b*. That is, the outer tube 63*a* and the inner tube 63*b* are integrated in both ends, and xenon gas is sealed in a closed space thereby formed in a space between them. A high voltage is applied between the above inner electrode 64 and the above outer electrode 62, whereby xenon atoms in the dual tube 63 are excited into an excimer state, and an ultraviolet light beam having a wavelength of approximately 172 nm is emitted when xenon atoms are restored from the above excimer state. In the present invention, as a discharge gas to be sealed in, the above xenon gas may be replaced with neon fluoride gas (wavelength 108 nm), argon gas (126 nm), krypton gas (146 nm), fluorine gas (157 nm), argon chloride gas (175 nm) or argon fluoride gas (193 nm). Further, for a light emission region of an ultraviolet light beam, the discharge gas can be selected from krypton chloride gas (222 nm), krypton fluoride gas (248 nm), xenon chloride gas (308 nm) or xenon fluoride gas (351 nm). In on example, the dual tube 63 has a total length of 400 mm, an outer diameter of approximately 30 mm, an inner diameter of approximately 17 mm, a tube thickness of approximately 1 mm and a discharge gap of approximately 5 mm. As shown in FIG. 8, the dual tube 63 is supported between the forward end portion 60A and the base portion 60C through resin rings 75 and 75.

The outer electrode 62 is a metal electrode constituted of a network-shaped metal wire in the form of a cylinder. The dual tube 63 is inserted into this cylinder of the outer electrode 62. An ultraviolet light beam emitted from the dual tube 63 passes through the network of the outer electrode 62 and further passes through the glass tube 61 to irradiate the surface of a work W. As shown in FIG. 9, a grounding cable 76 from the power source unit is connected to one end of the outer electrode 62 outside the above base portion 60C, so that a voltage can be applied from the above power source unit. The material for the outer electrode 62 is preferably a copper alloy or a stainless steel alloy.

The inner electrode 64 is a cylindrical metal tube disposed inside the dual tube 63 and opened on both ends. As shown in FIG. 8, one end of the inner electrode 64 on the side of the base portion 60C is fixed to a metal block 77, and the other end on the side of the forward end portion 60A is kept free. Electric power can be supplied to the inner electrode 64 through the gas tube 65. That is, a high-voltage cable 80 connected to the power source unit is directly connected to an end portion of the gas tube 65 (FIG. 9). The gas tube 65 is fixed to the metal block 77 fixing the inner electrode 64 (this connection is shown as a connection 81 in FIG. 9), so that the inner electrode 64 is electrically connected to the high-voltage cable 80 through the gas tube 65 and the metal block 77. The material for the inner electrode 64 is preferably a copper alloy or a stainless steel alloy. Further, in a preferred embodiment, the inner electrode 64 has an outer diameter of 15 mm and an inner diameter of 13 mm and forms a gap of 1 mm from the dual tube 63.

Figure 10:
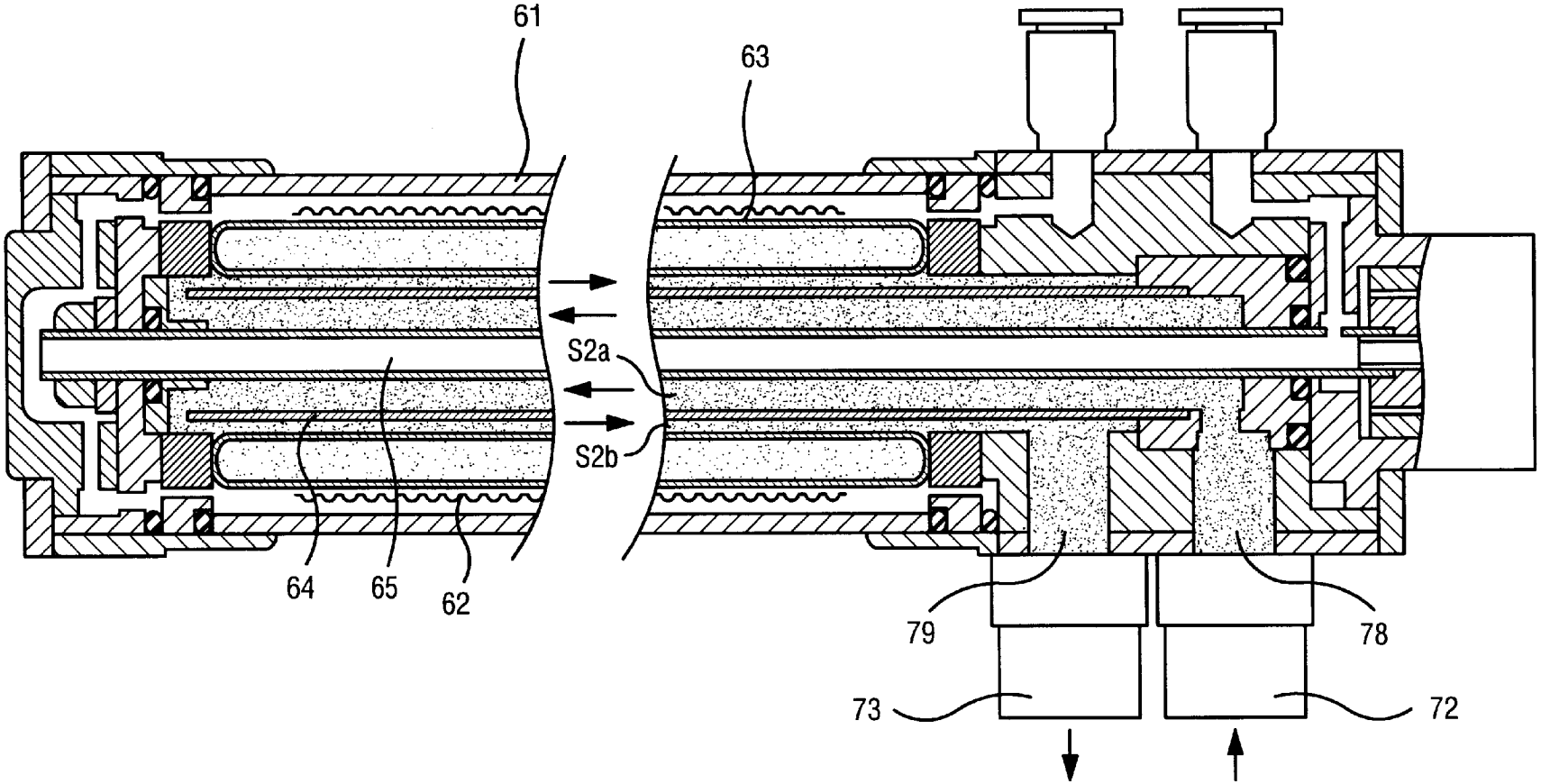
FIG. 10 is a drawing corresponding to FIG. 9, showing the flow of cooling water in the dielectric barrier excimer lamp.

As described already, the space S2 inside the dual tube 63 is separated into the two regions S2*a* and S2*b* inside and outside with the inner electrode 64. The cooling water inlet port 72 is allowed to communicate with the region S2*a* inside through a passage 78 in the base portion 60C, and the cooling water outlet port 73 is allowed to communicate with the region S2*b* outside through a passage 79. Further, the -above two regions S2*a* and S2*b* are allowed to communicate with each other in the forward end portion 60A. As a result, a circulating line of cooling water is formed inside the dual tube 63. As shown in FIG. 9, cooling water from a cooling water tube 82 connected to the cooling water supply source is introduced into the passage 78 (FIG. 8) in the base portion 60C from the cooling water inlet port 72, flows along the inside (region S2*a*) of the inner electrode 64 in the irradiation portion 60B and reaches the forward end portion 60A. In the forward end portion 60A, further, it moves into the outside (region S2*b*) of the inner electrode 64, flows the above region in the irradiation portion 60B and flows back to the base portion 60C. And, it flows through the passage 79 (FIG. 8) and is discharged into the cooling water tube 83 through the cooling water outlet port 73. During the above flowing, the inner electrode 64 is cooled. The flow of the cooling water can be controlled such that the flow is carried out only for the time period of irradiation with the ultraviolet light beam from the dielectric barrier excimer lamp II 60. FIG. 10 is a drawing corresponding to FIG. 9, showing the flow of cooling water in the dielectric barrier excimer lamp II, and FIG. 10 clearly shows what the flow of cooling water in this circulation line is like.

As shown in FIGS. 8 and 9, the gas tube 65 is a metal tube formed so as to have a diameter smaller than the diameter of the above inner electrode 64 and preferably made of a copper alloy or a stainless steel alloy. As shown in FIG. 8, the gas tube 65 is constituted to have a larger length than any other tube, and two ends thereof are fixed in the forward end portion 60A and the base portion 60C. In the base portion 60C, the end of the gas tube 65 is fixed to the metal block 77 as described above, and in a position outside, it communicates with the gas inlet port 70 through a passage 84, whereby the inert gas from the gas inlet port 70 can be introduced into the gas tube 65. In the forward end portion 60A, the gas tube 65 is allowed to communicate with a passage 85 formed inside. As will be described later, the inert gas is introduced into the space S1 outside the dual tube 63 through the passage 85. In a preferred embodiment, the gas tube 65 has an outer diameter of 6 mm and an inner diameter of 4 mm and forms a gap of 3.5 mm from the inner electrode.

The glass tube 61 is a cylindrical tube positioned outermost in the irradiation portion 60B. In the irradiation portion 60B, the above outer electrode 62, the above dual tube 63, the above inner electrode 64 and the gas tube 65 are housed in the glass tube 61. The glass tube 61 is preferably made of a synthetic quartz glass.

Figure 11:
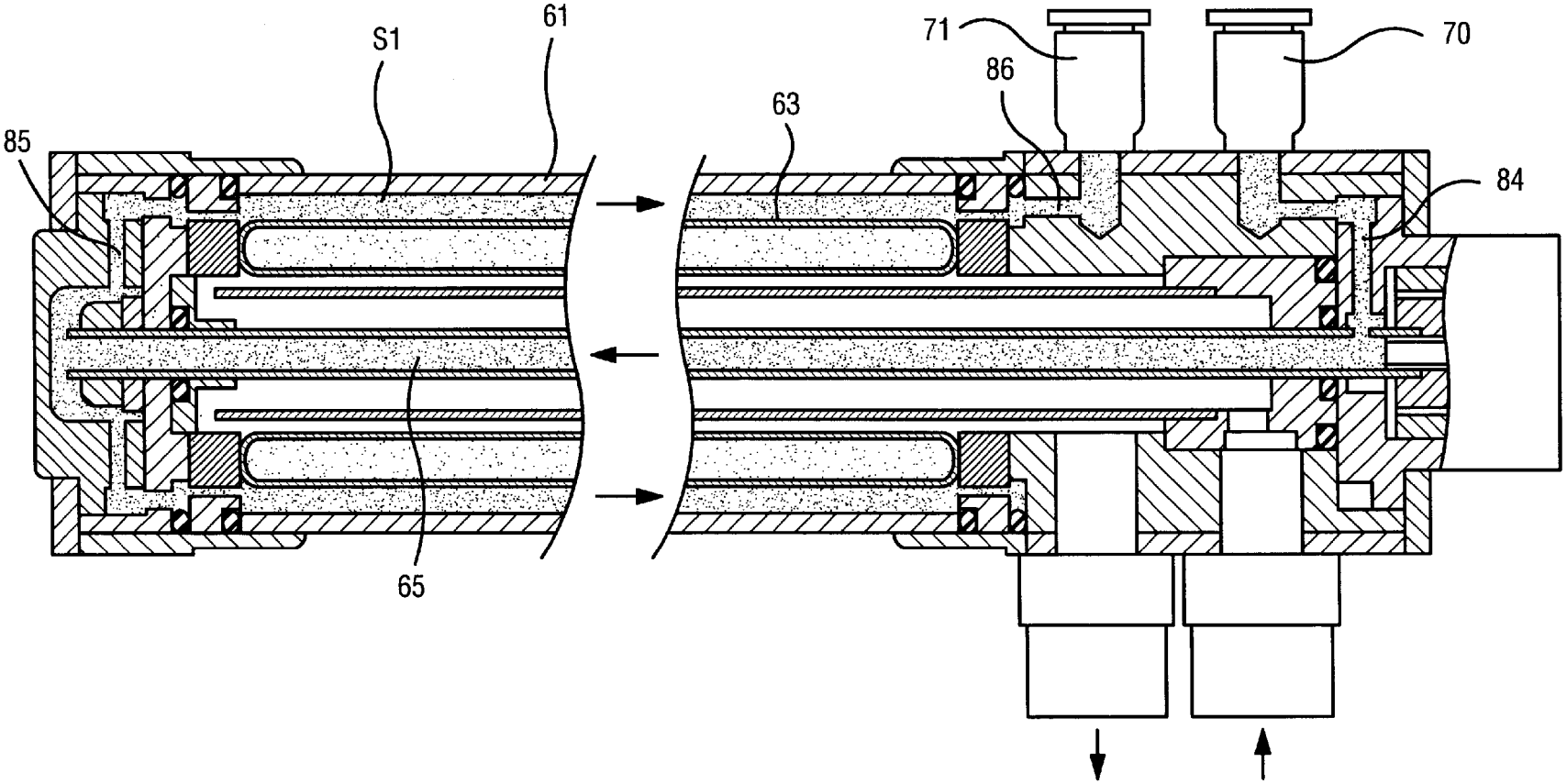
FIG. 11 is a drawing corresponding to FIG. 9, showing the flow of an inert gas in the dielectric barrier excimer lamp.

The predetermined space S1 is formed between the dual tube 63 and the glass tube 61, and the above inert gas is introduced therein to. In the forward end portion 60A, the above space S1 communicates with the above passage 85, and in the base portion 60C, it communicates with a passage 86 leading to the gas outlet port 71. As a result, the gas inlet port 70, the passage 84, the gas tube 65, the passage 85, the space S1, the passage 86 and the gas outlet port 71 constitute a circulation line of the inert gas. As shown in FIG. 9, the inert gas such as nitrogen or argon from a gas tube 87 connected to the inert gas supply source is introduced into the passage 84 (FIG. 8) in the base portion 60C through the gas inlet port 70, flows in the gas tube 65 and reaches the forward end portion 60A. Further, it moves from the passage 85 of the forward end portion 60A to the space S1 outside (FIG. 8), flows in it in the irradiation portion 60B and flows back to the base portion 60C. And, the inert gas flows through the passage 86 (FIG. 8) and is discharged into a gas tube 88 through the gas outlet port 71. When the above space S1 is filled with the inert gas, an ultraviolet light beam from the dual tube 63 is radiated out of the glass tube 61 without being attenuated in the space S1. The inert gas can be controlled to flow in before and after the irradiation with the ultraviolet light beam is carried out with the dielectric barrier excimer lamp II 60 and controlled to be shut off during the irradiation. FIG. 11 is a drawing corresponding to FIG. 9, showing the flow of the inert gas in the dielectric barrier excimer lamp II. FIG. 11 clearly shows what the flow of the inert gas in the above circulation line is like. In a preferred embodiment, the glass tube 61 has an outer diameter of 40 mm and an inner diameter of 36 mm, and a gap between the dual tube 63 and the glass tube 61 is 3 mm.

Figure 12:
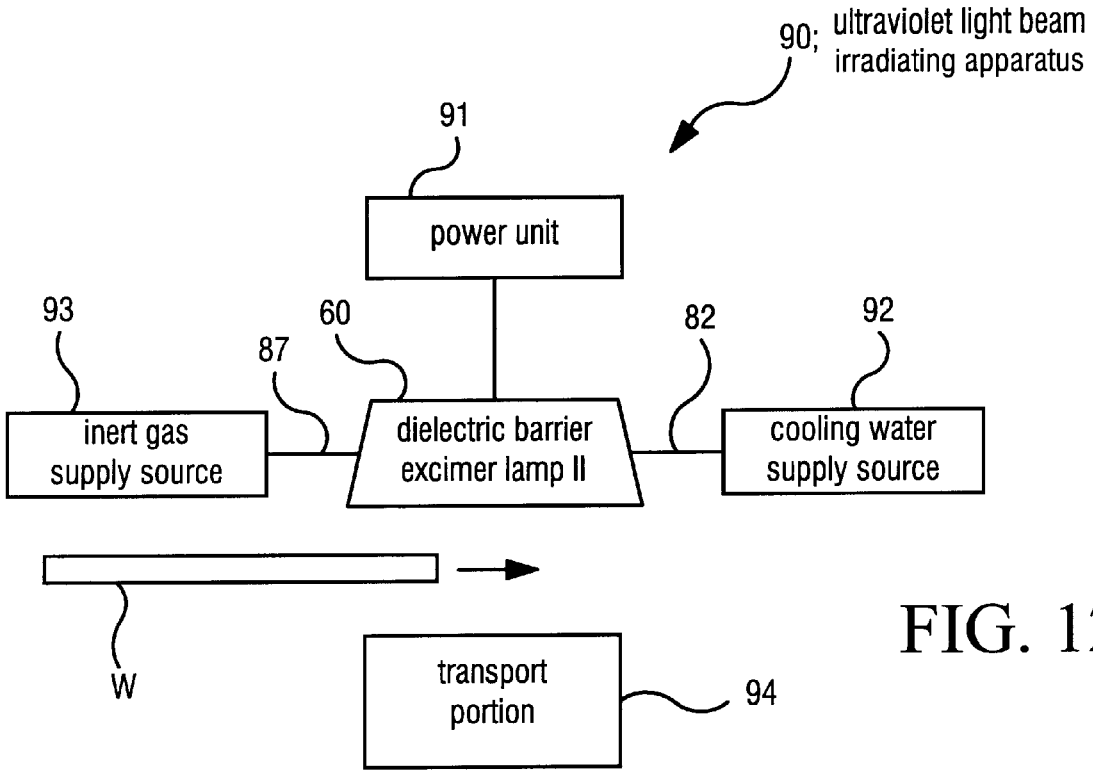
FIG. 12 is a block diagram of one example of the constitution of an ultraviolet light beam irradiating apparatus constituted by incorporating the dielectric barrier excimer lamp shown in FIG. 6.
Figure 13:
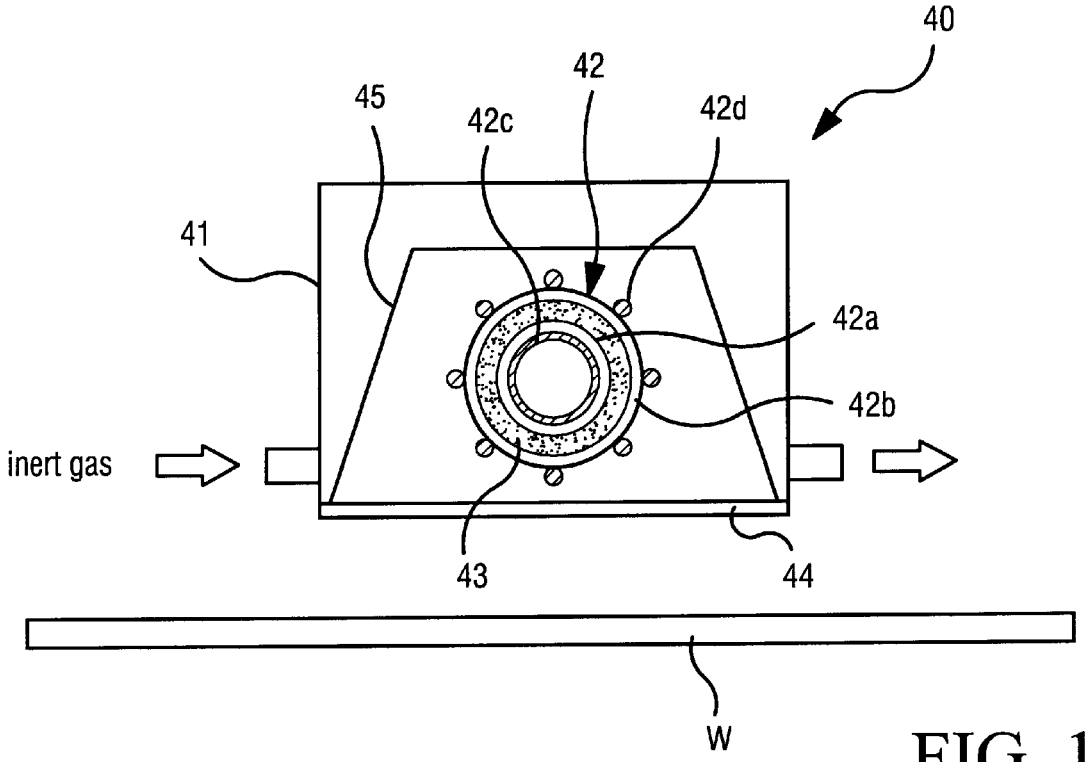
FIG. 13 is a constitution of one conventional dielectric barrier excimer lamp unit.

FIG. 12 is a block diagram of one constitution of the ultraviolet light beam irradiating apparatus 90 to which the above dielectric barrier excimer lamp II 60 is incorporated, provided by the present invention. The ultraviolet light beam irradiating apparatus 90 comprises the above-constituted dielectric barrier excimer lamp II 60, a power unit 91, a cooling water supply source 92, an inert gas supply source 93 and a transport portion 94.

The power unit 91 is for supplying a predetermined electric power to the electrodes (i.e., between the inner electrode 64 and the outer electrode 62) of the above dielectric barrier excimer lamp II 60 to emit an ultraviolet light beam. The supply of electric power from the power unit 91 is on-off controlled with a control portion disposed in the above power unit. The cooling water supply source 92 is for circularly supplying cooling water into the dual tube 63 of the dielectric barrier excimer lamp II 60 as described above. The cooling water from the cooling water supply source 92 is supplied to the dual tube 63 through the cooling water tube 82 and is also discharged from the dual tube 63. The inert gas supply source 93 is a means for supplying the above space S1 with the inert gas, and the above inert gas is supplied through the above gas tube 87.

The transport portion 94 is a mechanism for horizontally transporting a rectangular work W such as a glass substrate and allowing the work W through the irradiation range of ultraviolet light beam from the above dielectric barrier excimer lamp II 60. The transport portion 94 has a bed (not shown), which is for stably placing the work thereon and is moved together with the work. The height position of the bed is set such that the distance between the upper surface of the work to be placed thereon, i.e., a work surface, and the bottom portion of the dielectric barrier excimer lamp II 60 is 10 mm or less, preferably in the range of from 5 to 2 mm.

The ultraviolet light beam irradiating apparatus 90 having the above constitutions has a closed box (not shown) in which a stable atmosphere is maintained, and while the work W is transported inside the box, it can be irradiated with an ultraviolet light beam from the above dielectric barrier excimer lamp II 60. There may be employed a constitution in which a plurality of the above dielectric barrier excimer lamps II 60 are provided in the above ultraviolet light beam irradiating apparatus for broadening the irradiation range of the ultraviolet light beam therefrom. In this case, there may be employed a constitution in which the work is supported in the box by fixing it therein without moving it.

The procedures of cleaning the work W with the above ultraviolet light beam irradiating apparatus 90 will be explained below. The work W is transported into the box of the ultraviolet light beam irradiating apparatus 90 with a robot hand (not shown) or the like to place it on the bed of the transport portion 94. The work W is fixed onto the bed with an arbitrary fixing means. Simultaneously with placing the work W, the inert gas supply source 93 is initiated, and the inert gas is introduced into the dielectric barrier excimer lamp II 60 to fill the space S1 outside the above dual tube 63 with the gas. Functions in the ultraviolet light beam irradiating apparatus 90 are initiated by pressing down a start control button or by an arbitrary control timing. That is, the supply of electric power from the power source unit 91, the supply of cooling water from the cooling water supply source 92 and the transport of the work W with the transport portion 94 are initiated nearly simultaneously, whereby the dielectric barrier excimer lamp II 60 radiates an ultraviolet light beam to the surface of the moving work W to carry out the cleaning thereof. During this procedure, the dielectric barrier excimer lamp II 60 is cooled with the above cooling water.

One Example in the dielectric barrier excimer lamp II of the present invention has been explained with reference to drawings hereinabove. However, the present invention shall not be limited to particulars shown in the above Example, and it is clear that the present invention can be modified and improved on the basis of descriptions of claims. While the above Example has a constitution in which electric power is supplied to the inner electrode 64 through the gas tube 65, there may be employed a constitution in which the inner electrode 64 and the high-voltage cable 80 can be directly connected to each other.

As explained above, the dielectric barrier excimer lamp II of the present invention is easy to handle since it is small in size and since the outer electrode is not exposed on the outer surface side. Further, the necessary amount of the inert gas can be minimized, so that the running cost of the apparatus can be decreased. Further, the distance between the ultraviolet light beam source and the work can be minimized, which can improve the efficiency of the irradiation of the work with an ultraviolet light beam.

Further, the dielectric barrier excimer lamp II of the present invention has a constitution in which the circulating lines of the inert gas and the cooling water are provided inside the lamp. Therefore, the interfaces to external units and equipment for supplying the inert gas and the cooling water are collected in one place, so that the installing freedom thereof can be improved.

What is claimed is:

1. A dielectric barrier excimer lamp comprising a dielectric dual tube having an inner tube, a light-transmitting outer tube and a discharge gas sealed in a space between the inner and outer tubes, a case for housing said dual tube, the case being opened at least on one side of said dual tube in radius direction of said dual tube, an outer electrode which is fixed in an opened region of said case and includes a network-shaped region disposed close to the external-surface side of said outer tube on said one side of said dual tube, and an inner electrode disposed on an inner-surface side of said inner tube which inner-surface side corresponds at least to the region of the surface of said outer tube which surface is the surface close to which said outer electrode is disposed, wherein a voltage is applied between said outer electrode and said inner electrode to radiate an ultraviolet light beam through said network-shaped outer electrode.

2. The dielectric barrier excimer lamp of claim 1, wherein the dual tube is a cylindrical dual tube.

3. The dielectric barrier excimer lamp of claim 1, wherein the network-shaped region of the outer electrode is in contact with an outer surface of the outer tube.

4. The dielectric barrier excimer lamp of claim 3, wherein the outer electrode in a circumferential direction of the dual tube has a contact angle of 180° or less to the outer tube.

5. The dielectric barrier excimer lamp of claim 3, wherein the outer electrode is fixed to the case to press the network-shaped region to an external surface of the outer tube.

6. The dielectric barrier excimer lamp of claim 1, wherein the outer electrode has a fixing portion to the case on each side of the dual tube in the axial direction of the dual tube, and the outer electrode is fixed to the case via said fixing portions.

7. The dielectric barrier excimer lamp of claim 6, wherein the case is made of a metal, and the outer electrode is fixed to the case through an insulating member.

8. The dielectric barrier excimer lamp of claim 1, wherein the inner electrode extends in a direction of circumference of the inner tube and extends along half of said circumference.

9. The dielectric barrier excimer lamp of claim 1, further comprising an inert gas ejecting means which is disposed along the axial direction of the dual tube and which is for ejecting an inert gas toward an irradiation region of an ultraviolet light beam radiated through the outer electrode.

10. The dielectric barrier excimer lamp of claim 9, wherein the inert gas ejecting means is disposed on each side of the dual tube along the axial direction of the above dual tube.

11. The dielectric barrier excimer lamp of claim 9, wherein the inert gas ejecting means is fixed to the case so as to be present inside from the outer electrode, and an inert gas is ejected toward the irradiation region of the ultraviolet light beam through the outer electrode.

12. The dielectric barrier excimer lamp of claim 1, wherein the inner tube and the outer tube of the dual tube are made of a quartz glass.

13. The dielectric barrier excimer lamp of claim 1, wherein the discharge gas sealed in the dual tube is xenon gas.

14. A dielectric barrier excimer lamp comprising a dielectric dual tube having an inner tube, a light-transmitting outer tube and a discharge gas sealed in a space between the inner and outer tubes, a network-shaped first electrode disposed close to the outer circumferential surface of said outer tube, a second electrode disposed close to the inner circumferential surface of said inner tube, and a light-transmitting dielectric first tube for internally housing said dual tube together with said first and second electrodes, an inert gas being introducible into a first space between said first tube and said outer tube, wherein a voltage is applied between said first and second electrodes to radiate an ultraviolet light beam.

15. The dielectric barrier excimer lamp of claim 14, further comprising a gas inlet port which is connected to an inert gas supply source and which is for introducing the inert gas into the first space, a gas outlet port for discharging the inert gas introduced into the first space.

16. The dielectric barrier excimer lamp of claim 15, wherein the first space and a second space inside the inner tube are connected on a first end side of the dielectric barrier excimer lamp such that gas can be allowed to flow through, the gas inlet port and the gas outlet port are disposed on a second end side of the dielectric barrier excimer lamp, one of the gas inlet port and the gas outlet port is connected to the first space on the second end side of the dielectric barrier excimer lamp such that gas can be allowed to flow through, and the other thereof is connected to the second space such that gas can be allowed to flow through.

17. The dielectric barrier excimer lamp of claim 16, wherein the dielectric barrier excimer lamp has a second tube for transporting the inert gas into the second space, one end of the second tube is connected to one of the gas inlet port and the gas outlet port, and the other thereof is connected to the first space.

18. The dielectric barrier excimer lamp of claim 14, further comprising a cooling water inlet port which is connected to a cooling water supply source and is for introducing cooling water into the second space inside the inner tube, and a cooling water outlet port for discharging the cooling water introduced into the second space.

19. The dielectric barrier excimer lamp of claim 18, wherein the cooling water is introduced into a region outside the second tube in the second space.

20. The dielectric barrier excimer lamp of claim 14, wherein the second electrode is tubular.

21. The dielectric barrier excimer lamp of claim 20, wherein the tubular second electrode is spaced from an inner circumferential surface of the inner tube to separate the second space into a first region outside the second electrode and a second region inside it, the first region and the second region are connected to each other on the first end side of the dielectric barrier excimer lamp such that a liquid can be allowed to flow through, the cooling water inlet port and the cooling water outlet port are disposed on the second end side of the dielectric barrier excimer lamp, one of the cooling water inlet port and the cooling water outlet port is connected to the first region on the second end side of the dielectric barrier excimer lamp such that a liquid can be allowed to flow through, and the other thereof is connected to the second region such that a liquid can be allowed to flow through.

22. The dielectric barrier excimer lamp of claim 16, wherein the first and second electrodes are connected to a voltage source on the second end side of the dielectric barrier excimer lamp.

23. The dielectric barrier excimer lamp of claim 14, wherein the dual tube, the first tube, the second tube and the inner electrode are cylindrical tubes.

24. The dielectric barrier excimer lamp of claim 14, wherein the inner tube, the outer tube and the first tube are made of a quartz glass.

25. The dielectric barrier excimer lamp of claim 14, wherein discharge gas sealed in the dual tube is xenon gas.

26. The dielectric barrier excimer lamp of claim 14, which further comprises a reflection plate disposed so as to wrap a circumference of the first tube and used for focusing the ultraviolet light beam radiated outside the above first tube to one side.

27. An ultraviolet light beam irradiating apparatus comprising the dielectric barrier excimer lamp recited in claim 1.

28. An ultraviolet light beam irradiating apparatus comprising the dielectric barrier excimer lamp recited in claim 14.

* * * * *